US005509245A

United States Patent [19]

Gebhart

[11] Patent Number: 5,509,245

[45] Date of Patent: Apr. 23, 1996

[54] FORMWORK BRICK

[76] Inventor: Siegfried Gebhart, Tobelstadel, Germany

[21] Appl. No.: 251,744

[22] Filed: May 31, 1994

[30] Foreign Application Priority Data

Jun. 4, 1993 [DE] Germany ..... 43 18 578.9

[51] Int. Cl.[6] ..... E04B 1/88; E04C 1/00

[52] U.S. Cl. ..... 52/405.1; 52/405.4; 52/309.11; 52/309.12; 52/606

[58] Field of Search ..... 52/405.1, 405.4, 52/309.11, 309.12, 309.14, 309.17, 606

[56] References Cited

U.S. PATENT DOCUMENTS

| | | | |
|---|---|---|---|
| 3,204,381 | 9/1965 | Perreton | 52/405.4 X |
| 4,380,887 | 4/1983 | Lee | 52/606 X |
| 4,498,226 | 2/1985 | Perreto . | |
| 4,748,782 | 6/1988 | Johnson et al. | 52/606 X |
| 4,819,396 | 4/1989 | Cruise | 52/405.1 |
| 4,854,097 | 8/1989 | Haener . | |
| 4,856,249 | 8/1989 | Hickerson | 52/405.4 |
| 4,982,544 | 1/1991 | Smith | 52/606 |

FOREIGN PATENT DOCUMENTS

| | | |
|---|---|---|
| 2540538 | 8/1984 | France . |
| 1916400 | 3/1969 | Germany . |
| 2904850 | 8/1980 | Germany . |
| 3432925C2 | 9/1984 | Germany . |

*Primary Examiner*—Wynn E. Wood
*Attorney, Agent, or Firm*—Michael B. McMurry

[57] ABSTRACT

A formwork brick has two longitudinal walls, which form an external wall and internal wall, at least two cross walls, which extend over only a part of the brick height, a cavity lying between the walls for filling with concrete, and a first insulating insert, which is arranged on the inside of one of the two longitudinal walls. The cross walls are connected to the longitudinal walls such that the formwork brick has an H-shape. A set of second insulating inserts are placed in an inverted position over the cross walls enclosing the cross walls in the area of their reduced height.

14 Claims, 2 Drawing Sheets

FORMWORK BRICK

FIELD OF THE INVENTION

The invention relates to formwork brick and in particular to formwork bricks with a cavity or hollow space lying between the walls for filling with concrete and with insulating properties.

BACKGROUND OF THE INVENTION

In the building industry, especially that concerned with the building of houses, formwork bricks are increasingly being used, especially for cellars. They generally consist of concrete. Formwork bricks can, however, also be used for the complete walls of a house. In general, only the first layer of brick is set in mortar and the remainder of the wall is put up in dry condition in the form of modules or building bricks so that even people who are not experts in building can erect such structures.

Formwork bricks are therefore manufactured relatively accurately to size and mostly provided with groove and tongue for fitting together.

After the formwork bricks have been laid together one above the other to the desired height, their cavities are filled with concrete. This extremely simple process results in a very stable wall which has, however, very little in heat insulation properties.

For this reason, that is, to improve heat insulation, formwork bricks have been developed with insulating inserts.

Such a formwork brick is described in the DE-OS 19 16 400. It consists of light concrete and with an admixture of foamed plastic particles, and has an external wall, an internal wall, two face walls and a central connecting wall. The cavities formed by the brick connections are shielded at least on one side with plates of thermally insulated material. Noses or lug or ribs project inwards serving to hold these plates. The face walls and the connecting wall are provided at their top and bottom edges with semi-circle-shaped recesses to permit the overflow of the concrete to be filled in from one brick into the next in horizontal direction.

Another such formwork brick is also revealed in DE 34 32 925. It consists of an eternal wall, an internal wall and two face walls. In this formwork brick, too, an insulating insert is used to improve thermal insulation and soundproofing. This insert extends without interruption over the inside of the external wall, the insides of the two face walls and along the recesses which are located in the end faces and are used for filling with concrete. Although the above described formwork bricks possesses good heat insulating characteristics, they are still capable of being improved. The same considerations apply to the soundproofing characteristics of formwork bricks.

SUMMARY OF THE INVENTION

The object of the present invention is therefore to create a formwork brick of the type mentioned at the beginning of this description, which is easy to handle, has very good heat insulating characteristics and having greatly improved soundproofing characteristics.

According to the invention, these objects are achieved by constructing a formwork brick that has cross walls, related to the lateral end faces of the brick, which are placed inwards, through which, in the known manner, such that the formwork brick forms approximately an H-shape. Also, via the cross walls, an insulating insert is placed in inverted position in the formwork brick which encloses the cross walls laterally and in the area of their reduced height.

The formwork brick designed in this way is thereby excellently thermally insulated and, above all, soundproofed. The basis for this is offered by the creation of the cross walls shifted inwards, instead of what has been customary for face walls. In this way channels or cavities of a uniform size are created, which offer the ideal conditions for filling with concrete. Because the cross walls extend over only a part of the brick height, the formwork bricks of a row are in connection with one another with the concrete filling. A uniform spreading of the concrete pressure is ensured in this way, and so there is also a secure bond of the formwork bricks with each other.

The improved thermal insulation of the formwork brick according to the invention is achieved by, among other things, the cross walls placed inwards with the insulating insert placed in inverted position over them or enclosing them. With the formwork brick according to the DE 34 32 925, the cross walls of adjacent bricks disposed externally at the longitudinal walls touch one another directly. This results a very large uninsulated area, with a further disadvantage being that the cross walls joining each other can also be insulated only insufficiently by insulation.

Furthermore, the so-called well-known "tiled oven effect" can become particularly effective because the heat in the inner space is stored in the concrete.

A further advantage consists in that the groove and tongue customary with other formwork bricks at the end faces of the formwork bricks can be dispensed with.

The manufacture of such a "smooth" brick is thereby on the one hand significantly simplified. On the other hand, in this way the adaptation of the length of the wall bond to the desired length can be significantly simplified as, where required, only the free ends, i.e., those of the formed "H" of the longitudinal walls need be shortened.

In a further embodiment of the invention provision can be made for the outer wall to be fitted with an insulating insert, and that the cross walls are at least approximately flush on their underside, i.e., the underside of the longitudinal walls, with the insulating insert in each case being placed inverted over each cross wall from above.

This makes possible a simple completion of the formwork brick with the insulating insert.

At the same time, because the insulating insert fitted to the inside of the external wall and placed inverted over the two cross walls, the outward transport of heat is substantially reduced. In addition, virtually optimum soundproofing is achieved.

It is of advantage if the insulating insert for the longitudinal wall and for the cross walls is made in one piece. Both insulations can be completed in one operation.

Furthermore, it is desirable that the thickness of the insulating layers for the cross walls decreases towards the brick inside directed against the building interior in each case on both sides of the cross walls.

This makes possible a saving of material for the insulating inserts because the concentration of the material outward is fully adequate for the thermal insulation and soundproofing.

A further advantage of this reduction of width towards the inside of the brick results form the fact that more space is available for filling with concrete which makes possible a higher static load carrying capacity of a wall structure. This structure also makes it possible to create various types of wall shapes, a step shape for example.

It is, however, particularly advantageous if the insulating inserts for the cross walls (seen in plan view) are taper wedge-shaped towards the brick inside directed towards the inside of the building. This facilitates manufacture of the insulating inserts.

Provision can be made for width reduction of the insulating inserts in that this laterally surrounding area is at least approximately 2:1 from outside to inside.

A further advantageous embodiment of the formwork brick according to the invention consists of a formwork brick having a length of approximately 500 mm and the maximum width of each insulating insert for a cross wall is approximately 20 to 40 mm for the area projecting in each case laterally over a cross wall.

Also, for the formwork brick having a length of approximately 500 mm, the maximum width of each insulating insert is for one cross wall at least approximately 30 mm for the area laterally projecting over a cross wall.

These values have turned out to be particularly advantageous in practice.

In addition for this formwork brick having a length of 500 mm, the cross walls will preferably have a thickness of approximately 50 mm each and a distance of 200 mm from each other, resulting in continuously equal spaces for filling with concrete.

It is also possible, however, to construct a formwork brick having a thickness of approx. 300 mm, where the wall thicknesses of the longitudinal walls are approx. 45 to 55 mm and the insulating insert, which extends along a longitudinal wall, are approximately 50 to 60 mm.

In a further embodiment of the invention it can, in addition, be planned that the area of each insulating insert covering the cross walls on the top side is 10 to 30 mm.

It has been found even more advantageous in practice if the area of each insulating insert covering the top of the cross walls is approximately 15 mm.

All these values have turned out to be the most effective in practice. The formwork brick designed in this way thereby requires relatively little material and is nevertheless very stable. This results in a formwork brick which is particularly handy for laying.

It can be manufactured from expanded day material and the concrete filling can be in the form of light concrete.

A very advantageous further embodiment of the invention can consist in that the insulating inserts for the longitudinal wall as well as the cross walls consists of polystyrene. While the filled-in concrete shrinks after a certain time polystyrene, offers the possibility of compensating for this shrinkage again for the insulating inserts in that it is first pressed a little during concrete filling and after shrinkage of the concrete filling it again expands into its old shape. In this way cavities and thus sound and coldness bridges are avoided.

A very advantageous embodiment of the invention can also consist in the fact that the cross walls in the connecting area to the longitudinal walls possess transition areas directed towards the top side of the brick.

By this method an improved stability of the formwork brick is achieved. The transition area is possible in the shape of a radius or else in a simply oblique form for easier manufacturing.

DETAILED DESCRIPTION OF THE INVENTION

Figure 1:
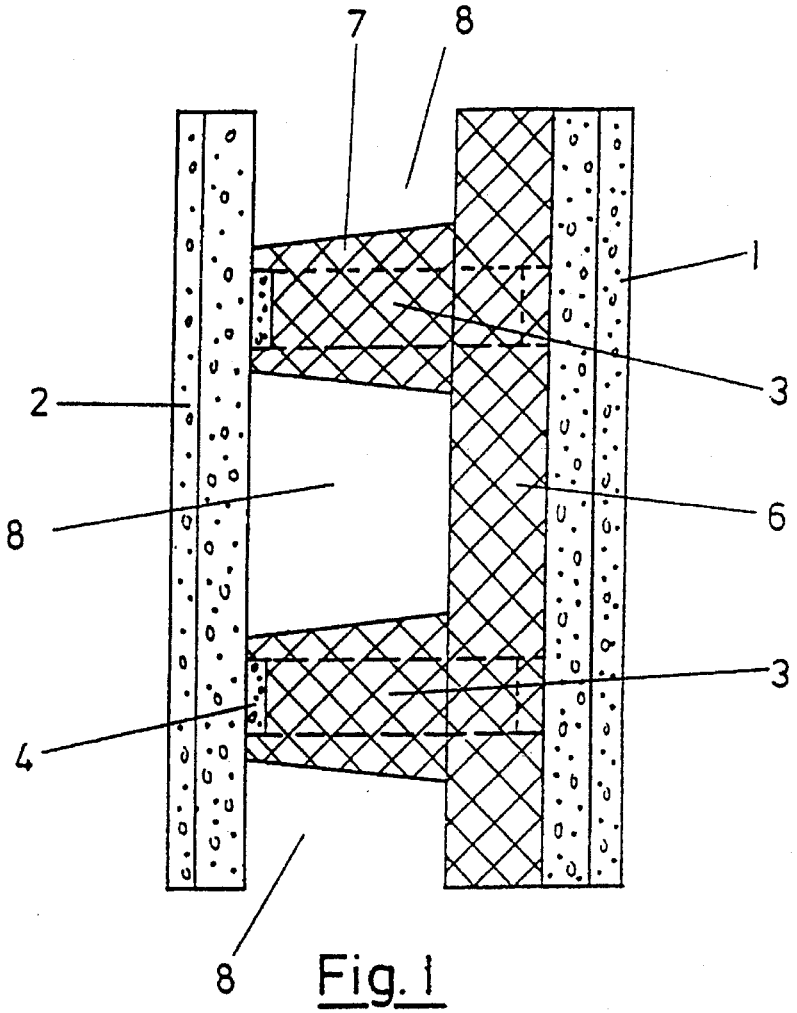
FIG. 1 is a plan view of the formwork brick according to the invention.
Figure 2:
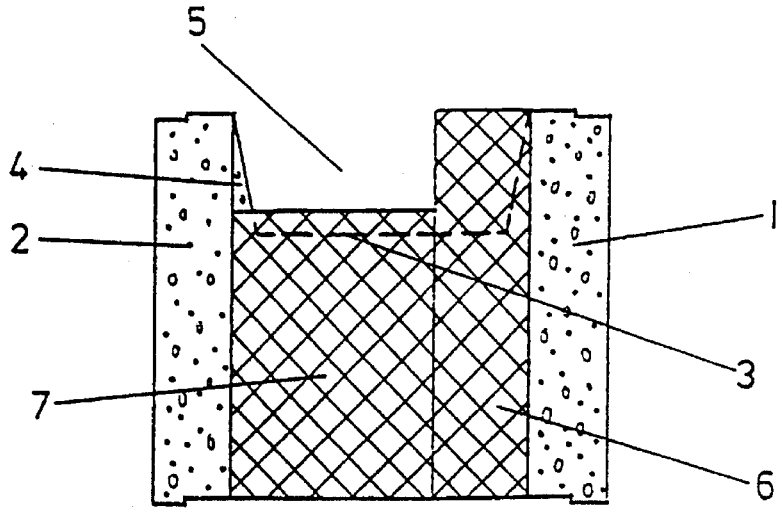
FIG. 2 is a side view of the formwork brick of FIG. 1.
Figure 3:
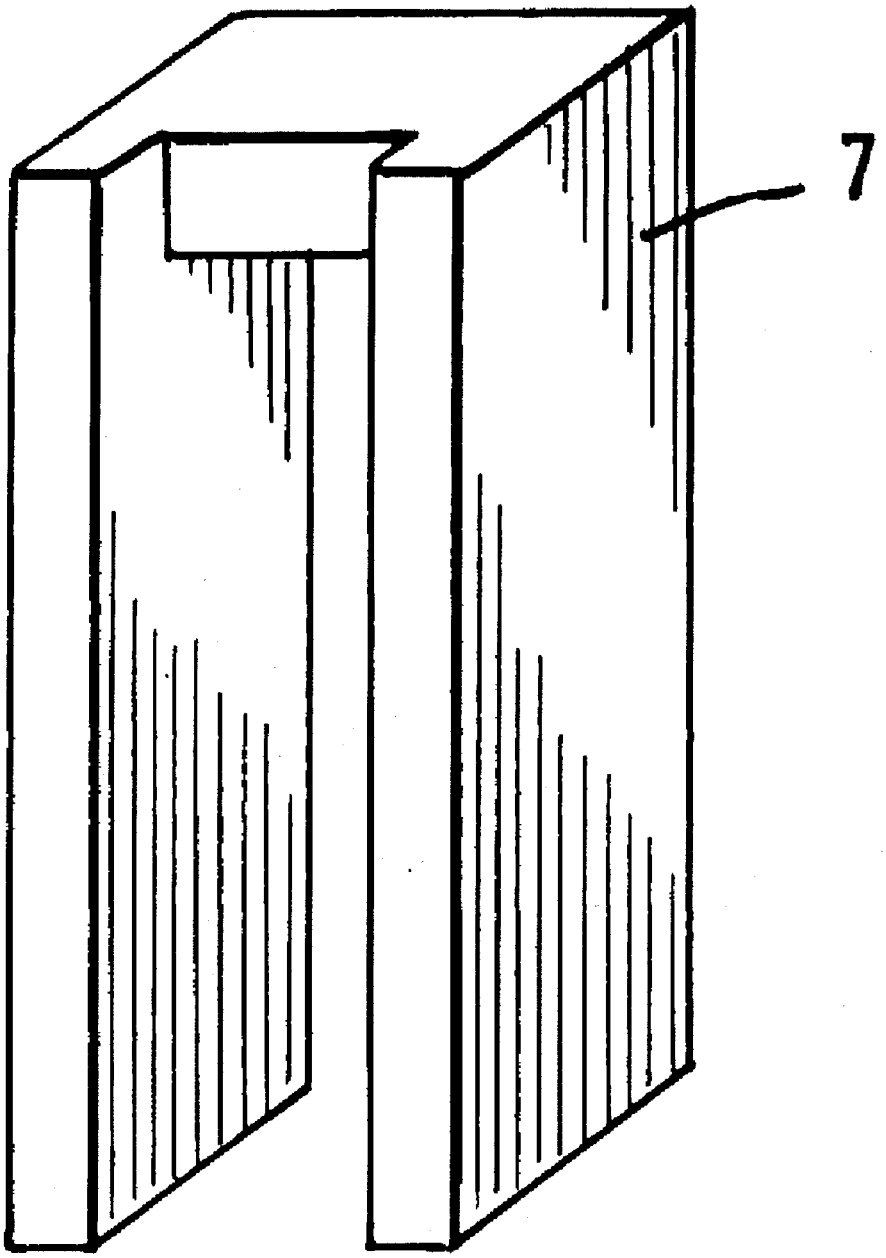
FIG. 3 is a front perspective view of an insulating insert for use with the form work brick of FIGS. 1 and 2.

The formwork brick has two longitudinal walls which form an external wall 1 and an internal wall 2. Both longitudinal walls 1 and 2 are approximately 500 mm long, 250 mm high and have a wall thickness of approx. 45 to 55 mm. They are connected to each other at right angles by two cross walls 3 (broken-line representation).

Related to the lateral end faces (the end face of the external and the internal wall 1 and 2), the cross walls are then in each case place approx. 100 mm inwards so that the formwork brick forms approximately the shape of an "H" and produces a total width of the formwork brick of approx. 300 mm.

Related to the formwork brick length of approx. 500 mm, the cross walls 3 are arranged at a distance of approx. 200 mm from each other. In this way, even when the individual formwork bricks are laid one beside the other, i.e. each row is offset by one half a side length with respect to the other, there always results the same distance of approx. 200 mm.

Both cross walls 3 are connected flush on their underside with the brick underside and extend up into a brick height of approx. 170 mm.

In their connecting area the cross walls 3 possess approximately 80-mm-high, inclined transition areas 4 directed towards the upper side of the brick. Due to the cross walls extending up to the brick top side only in the transition areas, free spaces 5 are created, which are useful for the later filling with concrete horizontally in the longitudinal direction of the brick.

An insulating insert 6 is located on the inside of external wall 1. It has the same length and height as the external wall and an approximately 50 to 60-mm-thick wall thickness. Another U-shaped insulating insert 7, which encloses each cross wall 3 laterally and in the area of its reduced height, is placed inverted from above over each cross wall 3 flush with the underside of the insulating insert 6 and the underside of the formwork brick.

Each insulating insert 7 covers on the top side the cross walls 3 in the height by approximately 15 mm. This dimension, projecting over the cross walls 3, can also vary between approximately 10 to 30 mm.

The width of the insulating insert 7 decreases against the brick inside directed towards the inside of the building, in each case on both sides of the cross walls 3.

From FIG. 1 it can be seen that this is achieved in that these insulating inserts 7 taper wedge shaped in the direction described in the foregoing. The ratio of this width reduction from outside to inside is approx. 2:1.

Each cross wall 3 is also in each case covered by the insulating insert 7 on both sides of the cross wall 3 in an area of 20 to 40 mm, but at least approximately 30 mm.

The walls 1, 2 and 3 as well as the insulating inserts 6 and 7 enclose a cavity 8 formed in this way, which is in connection with the formed free spaces 5 of adjacent formwork bricks. Due to the cavities 8 of equal size and the free spaces 5, concrete can be filled in from above after the formwork bricks have been laid in bond. In this way, the insulating inserts 6 and 7 are held in their position, too and do not need to be specially fastened to the formwork brick walls.

I claim:

1. Formwork brick having a longitudinal external wall and a longitudinal internal wall, comprising:

at least two cross walls connecting the external wall to the internal wall which extend upwardly for only a portion of the height of the longitudinal walls;

a first insulating insert located on an inside surface of at least of one of the two longitudinal walls extending only a portion of the distance between the external and the internal wall; and a pair of spaced apart second insulating inserts each abutting said first insulating insert and extending transversely and abutting to the other one of said two longitudinal walls and enclosing said cross walls so as to form a cavity between said pair of second insulating inserts and said first insulating insert suitable for receiving concrete.

2. The formwork brick of claim 1 wherein said first insulating insert abuts the external wall and wherein the lower portions of said cross walls are substantially even with the lower portions of said longitudinal walls and wherein said second insulating inserts are U-shaped and placed in an inverted position over said cross walls.

3. The formwork brick of claim 1 wherein said first and second insulating inserts are unitary.

4. The formwork brick of claim 1 wherein said second insulating inserts are substantially wedge shaped wherein the width of said second insulating inserts increases in the direction away from the internal wall.

5. The formwork brick of claim 4 wherein a first end of said second insulating inserts abuts said internal wall and the second end of said second insulating insert abuts said first insulating insert and wherein said first end has a greater width than said second end.

6. The formwork brick of claim 5 wherein the ratio of the width of said second end to said first end is approximately 2:1.

7. The formwork brick of claim 6 wherein the longitudinal walls have a length of approximately 500 mm and the maximum width of each said second insulating insert is approximately 20 to 40 mm.

8. The formwork brick of claim 7 wherein said maximum width of each said insulating insert is at least 30 mm.

9. The formwork brick of claim 7 wherein said cross walls have a thickness of approximately 50 mm and are spaced apart by approximately 200 mm.

10. The formwork brick claim 6 wherein the longitudinal walls have a length of approximately 300 mm and a thickness of approximately 45 to 55 mm and said first insulating insert has a thickness of approximately 50 to 60 mm.

11. The formwork brick of claim 2 wherein the width of each of said second insulating inserts covering the top surface of said cross walls is approximately 10 to 30 mm.

12. The form work brick claim 10 wherein said width of said second insulating inserts covering said top surface said cross walls is approximately 15 mm.

13. The formwork brick of claim 1 wherein said first and second insulating inserts are configured out of a material including polystyrene.

14. The formwork brick of claim 1 wherein said cross walls include a pair of inclined transition portions each of which extends at an angle upwardly from the top surface of each of said cross walls to the top of the longitudinal walls.

* * * * *